US011359423B2

(12) United States Patent
Hoffmann et al.

(10) Patent No.: US 11,359,423 B2
(45) Date of Patent: Jun. 14, 2022

(54) RETAINER HOUSING FOR A DOOR CHECK

(71) Applicant: Edscha Engineering GmbH, Remscheid (DE)

(72) Inventors: Peter Hoffmann, Overath (DE); Josef Kasberger, Büchlberg (DE); Heiner Ackers, Wuppertal (DE); Torsten Meissner, Remscheid (DE)

(73) Assignee: EDSCHA ENGINEERING GMBH, Remscheid (DE)

( * ) Notice: Subject to any disclaimer, the term of this patent is extended or adjusted under 35 U.S.C. 154(b) by 0 days.

(21) Appl. No.: 15/734,549

(22) PCT Filed: Jun. 5, 2019

(86) PCT No.: PCT/DE2019/100502

§ 371 (c)(1),
(2) Date: Dec. 2, 2020

(87) PCT Pub. No.: WO2019/233530

PCT Pub. Date: Dec. 12, 2019

(65) Prior Publication Data

US 2021/0230915 A1 Jul. 29, 2021

(30) Foreign Application Priority Data

Jun. 6, 2018 (DE) ..... 10 2018 113 524.6

(51) Int. Cl.
*E05C 17/22* (2006.01)
*E05C 17/20* (2006.01)
*E05C 17/00* (2006.01)

(52) U.S. Cl.
CPC ..... *E05C 17/203* (2013.01); *E05C 17/025* (2013.01)

(58) Field of Classification Search
CPC ... Y10T 16/61; Y10T 16/629; Y10T 16/6295; Y10T 292/285; Y10T 292/286;
(Continued)

(56) References Cited

U.S. PATENT DOCUMENTS 7,240,399 B2 * 7/2007 Murayama ..... E05C 17/203 16/82
7,870,641 B2 1/2011 Hoffmann et al.
(Continued)

FOREIGN PATENT DOCUMENTS

CA 2998496 A1 5/2017
DE 19815981 A1 10/1999
(Continued)

OTHER PUBLICATIONS

Corresponding PCT International Search Report of PCT/DE2019/100502.

*Primary Examiner* — Chuck Y Mah

(57) ABSTRACT

A retainer housing, in particular for a door check (30), includes a first housing part (2) with a cavity (3) for receiving a brake body (50) and a spring system (40) of a door check (30). The first housing part (2) has a first end (2*b*) and a second end (2*c*), and a closing piece (104) which is situated on one of the first end (2*b*) and second end (2*c*) of the housing part. The closing piece (104) has an upper face (104*a*) and a lower face (104*b*). Multiple elevations (6) are arranged on the lower face (4*b;* 104*b*) of the closing piece (4; 104), concentrically around a centre point of the lower face (4*b;* 104*b*). The elevations (6) have a stop face (7) for a spring system (40) of a door check (30).

16 Claims, 4 Drawing Sheets

(58) Field of Classification Search
CPC ... Y10T 292/304; E05C 17/025; E05C 17/04; E05C 17/12; E05C 17/20; E05C 17/203; E05C 17/206; E05C 17/22; E05C 17/26; E05C 17/24; E05C 17/28; E05C 17/18; E05F 5/025; E05F 5/08; F05F 5/06; F05F 5/08; F05F 5/12; E05Y 2900/531; E05Y 2201/224; E05Y 2201/248; E05Y 2201/25; E05Y 2201/696; E05Y 2201/702; B60J 5/047
See application file for complete search history.

(56) References Cited

U.S. PATENT DOCUMENTS

| | | | | |
|---|---|---|---|---|
| 10,570,653 | B2 * | 2/2020 | Gruber | E05C 17/203 |
| 2006/0207058 | A1 * | 9/2006 | Heinrichs | E05C 17/203 16/86 B |
| 2006/0267353 | A1 * | 11/2006 | Van Den Heuvel | E05C 17/203 292/262 |
| 2007/0241569 | A1 * | 10/2007 | Kitayama | E05C 17/203 292/262 |
| 2008/0066260 | A1 * | 3/2008 | Clark | E05C 17/203 16/86 A |
| 2010/0154163 | A1 * | 6/2010 | Hoffmann | E05C 17/203 16/85 |

FOREIGN PATENT DOCUMENTS

| | | | |
|---|---|---|---|
| DE | 10251174 | A1 | 5/2004 |
| DE | 202005017958 | U1 | 3/2007 |
| DE | 102005044103 | A1 | 4/2007 |
| WO | WO2012131187 | A1 | 10/2012 |

* cited by examiner

RETAINER HOUSING FOR A DOOR CHECK

The present disclosure relates to a retainer housing for a door check, a door check, and a method for producing a retainer housing for a door check.

BACKGROUND

In practice, door checks for vehicles are known which comprise a retainer housing and a door retaining rod passing through the retainer housing, wherein at least one brake body is arranged in the retainer housing, wherein said brake body is preloaded by a spring system arranged in the retainer housing in the direction towards a guide surface provided on the door retaining rod and thus causes a displacement of the retainer housing relative to the door retaining rod to be braked. The retainer housing is firmly connected to one of the body and the vehicle door, wherein the door retaining rod is hingedly connected with a first end to the body and with a second end to the vehicle door.

DE 10 2005 044 103 A1 describes a door check with a retainer housing which comprises a first housing part, a brake body and a spring system which are received in a cavity of the first housing part. The door check further comprises a door retaining rod passing through the retainer housing, the door retaining rod having a first guide surface and the spring system preloading the brake body in the direction towards the first guide surface. The retainer housing of the door check comprises a lid-shaped closing piece, which is arranged on an end of the retainer housing facing away from the guide surface of the door retaining rod, a fixing embossing being provided on the retainer housing which fixes the closing piece on the housing part of the retainer housing. The closing piece has a lower face which serves as a stop surface for the spring system. The disadvantage of the door check or retainer housing shown is that manufacturing tolerances of the components used, in particular of the spring system or also of the brake body, can only be compensated for with great effort.

DE 198 15 981 A1 shows a door check having a retainer housing which is formed from a one-piece metal sheet blank, a cavity being provided in the retainer housing in which a spring system and a brake body are arranged. A door retaining rod passes through the retainer housing. The spring system comprises a helical spring which rests with a first end on the brake body and rests with a second end on an upper face of the retainer housing. A stop surface for the helical spring is provided on the upper face, wherein the stop surface can be displaced parallel to a longitudinal axis of the retainer housing for adjusting the preload of the spring system. The disadvantage of the door check shown is that the housing consists of a metal and, moreover, the adjustment of the stop surface can lead to a deformation of the entire housing and thus the functionality of the spring system and the brake body is restricted.

WO 2012/131 187 A1 shows a door check having a housing, comprising a first housing part with a cavity for receiving a brake body and a spring system, the first housing part having a first end and a second end. The door check further comprises a closing piece which is arranged on the end of the housing part facing away from a door retaining rod, the closing piece having an upper face and a lower face. The closing piece has a stop surface on the lower face thereof which runs in a spiral shape around an elevation located in the center. The stop surface is designed to be in contact with a first end of the spring system designed as a spiral spring. The disadvantage of the door check shown is that the stop surface can only insufficiently compensate for manufacturing tolerances, in particular of the spring system designed as a helical spring.

DE 102 51 174 A1 shows a door check, the door check comprising a retainer housing. The retainer housing comprises a first housing part with a cavity for receiving a brake body and a spring system designed as a compression spring, wherein the first housing part has a first end and a second end. The door check further comprises a closing piece designed as a plate that is arranged at one of the first end and the second end of the housing part, wherein the closing piece has an upper face and a lower face. On the lower face of the closing piece, an elevation relative to an edge region is provided which elevation is formed by embossing.

CA 2 998 496 A1 shows a door check having a retainer housing comprising a C-shaped first housing part having a first end and a second end. At the ends of the housing part elevations which face one another are provided, each serving as a guide aid for each first end of a spring system designed as a compression spring. The spring system preloads a brake body in the direction towards a guide surface of a door retaining rod.

SUMMARY

It is an object of the present disclosure to provide a retainer housing or a door check which offers a flexible and cost-effective possibility of compensating for manufacturing tolerances of the components used, in particular of the spring system. Furthermore, an object of the present disclosure is to specify a method for producing a door check, which makes it possible to subsequently compensate for existing manufacturing tolerances of the components to be installed, in particular of the spring system.

According to one aspect of the present disclosure, a retainer housing, in particular for a door check, is created, comprising a first housing part having a cavity for receiving a brake body and a spring system of a door check, the housing part having a first end and a second end. The retainer housing further comprises a closing piece which is arranged at one of the first end and the second end of the housing part. The closing piece has an upper face and a lower face. The retainer housing according to the present disclosure is characterized in that a plurality of elevations are arranged on the lower face of the closing piece, concentrically around a center of the lower face, wherein the elevations have a stop surface for a spring system of a door check. In this way, deviations in the cavity that occur due to manufacturing tolerances can advantageously be compensated for by appropriate design of the elevation. In particular, differences in length of the preloading means used in the spring system of a door check and thus the force which is exerted by the spring system on the brake body can be adapted or set. Advantageously, further, an adjustment of the configuration of the closing piece can flexibly take place in accordance with the conditions predetermined by the spring system. In particular, incorrect inclinations of the end faces of the preloading means used in the spring system can be compensated for in that the heights of the various elevations are variably and independently adjusted. In addition, a uniform support of the spring system on the stop surfaces of the elevations is advantageously ensured, in particular in the event that the spring system comprises helical springs which have arc-shaped end faces. Furthermore, by adjusting the elevation, the preloading force of the spring system, which acts on the brake body, can also be changed and set subsequently.

In a preferred development, elevations that are adjacent to one another are arranged equidistant from one another. Particularly preferably, the lower face or the elevation is facing the other of the first end and the second end of the housing part. Expediently, in particular the distance between the lower face of the closing piece and a brake body arranged on the other of the first end and second end can be reduced or increased and the strake of the brake body or the preload of the brake body in the direction towards a guide surface of a door retaining rod can be set.

The spring system expediently has a first end which is in contact with the stop surface of the elevation. A second end of the spring system, in turn, is in contact with a stop surface of the brake body, so that the brake body is effectively preloaded against a guide surface of a door retaining rod of a door check.

In a preferred embodiment, the stop surface of the elevation is flat. Usually the preloading means used in the spring system, in particular helical springs, have flattened end faces at their ends, so that a support as flat as possible on the stop surface of the elevation is advantageously made possible and a regular force is accordingly implemented. In particular it is advantageously prevented that a deformation of either the elevation or the end faces of the spring system is occurring in the event of increased preloading forces. In an alternative embodiment, the stop surface can have a spherical design.

The stop surface expediently has a circular border. In this way, sharp-edged corners are advantageously avoided, which can have a disadvantageous effect on the preload of the spring system. Alternatively the stop surface can also have a generally elliptical border. In an advantageous embodiment, the stop surface is designed as being arc-shaped. In this way, a continuous stop surface is provided, so that a uniform application of force is made possible.

In a particularly preferred embodiment, the elevation is designed as an embossed dimple. The elevation can advantageously be manufactured simply and cost-effectively using an embossing tool, and it is also made possible to subsequently adjust the height of the elevation, in particular when the spring system and brake body are installed, by pushing said elevation back. The closing piece is preferably pre-embossed before installation in the retainer housing, i.e., the height of the embossed dimples or of the elevation is set to a specific value, with the height being able to be set subsequently.

In an alternative development, the elevation is designed as an embossed ring.

The embossed ring is preferably designed to be arc-shaped so that a continuous stop surface is provided for the spring system. When using helical springs in the spring system, the embossed ring is designed as a circular arc, so that the helical spring provided in the spring system is in full contact with the stop surface of the embossed ring. This advantageously enables a uniform force distribution over the entire stop surface and thus avoids the risk of a deformation of the elevation designed as an embossed ring and thus avoids that the effective preloading force of the spring system is unintentionally changed.

In a preferred embodiment, the closing piece is fixed on an inner face of the housing part surrounding the cavity. The closing piece is expediently fastened in such a way that the lower face of the closing piece is arranged substantially perpendicular to the inner face of the housing part. This advantageously ensures that the spring system abuts flatly against the stop surfaces of the elevations, thus ensuring regular deformation of the springs.

The inner face of the housing part particularly preferably has a groove for receiving an edge region of the closing piece. In this way, the closing piece can advantageously be fixed to the housing part positively, so that no displacements of the closing piece are carried out by the spring system relative to the housing part, even under a high load of force.

In an expedient embodiment, the closing piece closes the cavity on one side at one of the first and second ends of the housing part. The closing piece particularly preferably closes the cavity in a watertight manner. In this way, the spring system and the brake piece can advantageously be largely protected from moisture, thus increasing the reliability of the entire door check and reducing the susceptibility to errors.

In a particularly preferred development, the closing piece has at least one bore in an edge region for fixing the closing piece. The closing piece particularly advantageously has two opposing bores. In this way, a rotation lock of the closing piece in the housing part can advantageously be ensured. The edge region in which the bore is provided is particularly preferably designed as a nose-shaped projection. In this way, area is advantageously provided that is sufficiently large for the bores without an unnecessarily large amount of construction material being used for producing the closing piece.

The closing piece is expediently designed as a plate. The plate is particularly advantageously made of metal, in particular steel. Advantageously, the elevations can easily be produced using appropriate embossing tools, the metal being made so thin that embossing is possible and at the same time being made at least so thick that the forces acting on the elevations, which are caused by the spring system du ring operation of the door check, do not result in any deformation of the elevations.

The housing part is particularly preferably made of plastic. In this way, the housing part can advantageously be reliably and precisely manufactured using injection molding tools. Particularly preferably, at least the edge region of the closing piece is enclosed by the housing part, which is achieved in particular by encapsulation of the closing piece when producing the housing part. In this way, cost-effective and secure positioning of the closing piece relative to the housing part can advantageously be ensured.

In an advantageous embodiment, it is provided that one of the elevations is arranged in the center of the lower face. In this way, spring systems which are arranged concentrically about the center of the lower face and have a rather small outer circumference can be reliably controlled and set in a particularly advantageous manner.

According to one aspect of the present disclosure, a door check is created, comprising a retainer housing and a retaining rod passing through the retainer housing. The door retaining rod has a first guide surface. The door check further comprises a first brake body and a first spring system, wherein the first spring system preloads the brake body in the direction towards the first guide surface. The door check is characterized in that the retainer housing is designed as described above. Advantageously, a door check is thus created which can also be adapted subsequently by changing the height of the elevations arranged on the lower face of the closing piece with respect to the installation space and in particular allows the retaining moments produced by the door check to be set.

The first brake body preferably comprises an end portion facing the first guide surface, wherein the end portion has an inner surface facing away from the guide surface, wherein an inner hollow cylinder surrounded by an outer hollow cylinder portion is arranged on the inner surface. Thereby, advantageously, the possibility of radially supporting the preloading means by the inner hollow cylinder is created, which preloading means are provided in the spring system and which have a small inner diameter, in order to, in particular, prevent the preloading means from bending transversely to the longitudinal axis thereof.

In an advantageous embodiment, it is provided that the first spring system comprises a first spring part and a second spring part. The second spring part particularly preferably radially circumvents the first spring part. In the event that the elevations on the lower face of the closing piece are arranged concentrically around the center of the lower face, the effective preloading of the first spring part and the second spring part can be set separately by adjusting the height of the associated elevations. The first spring part particularly preferably has a smaller outer diameter than the elevation arranged in the center of the lower face, so that the end face of the first spring part rests completely on the stop surface of the corresponding central elevation. Alternatively, it can also be provided that the lower face has no elevation in the region of the support surface of the first spring part and has elevations arranged concentrically around the center of the lower face or an arc-shaped embossed ring in the region of the support surface of the second spring part. In this case, the adjustment of the retaining moments or the braking force is only carried out by corresponding adjustment of the preloading force of the second spring part, the entire retaining torque still being adjusted since the preload of the brake body in the direction towards the guide surface is provided by both spring parts in total.

According to one aspect of the present disclosure, a method for producing a retainer housing for a door check, in particular a door check as described above, is created. In a first step, the method comprises embossing a metal sheet provided as a closing piece, which has one or more bares in an edge region, in an embossing tool, one or more elevations being produced on a lower face and accordingly corresponding depressions are produced on an upper face of the metal sheet. In a second step, inserting of the pre-embossed metal sheet into an injection molding tool is carried out. In a third step, the producing of the plastics housing part is carried out and simultaneously the encapsulation of the edge region of the pre-embossed metal sheet with the plastics material is carried out. In a fourth step, pushing back of one or more of the previously produced elevations on the lower face of the metal sheet is carried out. This production method advantageously creates the possibility of subsequently compensating for manufacturing tolerances of both the housing part and the spring system or the brake body by adjusting the height of the elevations and thus ensuring that the retaining moments of the entire door check can be set precisely. The encapsulation of the edge region of the pre-embossed metal sheet or closing piece provided when producing the housing part also ensures precise positioning of the metal sheet or closing piece relative to the housing.

Further advantages, developments and characteristics of the present disclosure can be found in the following description of preferred embodiments.

BRIEF SUMMARY OF THE DRAWINGS

The present disclosure will now be explained in more detail with reference to the accompanying drawing based on preferred embodiments of the present disclosure.

DETAILED DESCRIPTION

Figure 1:
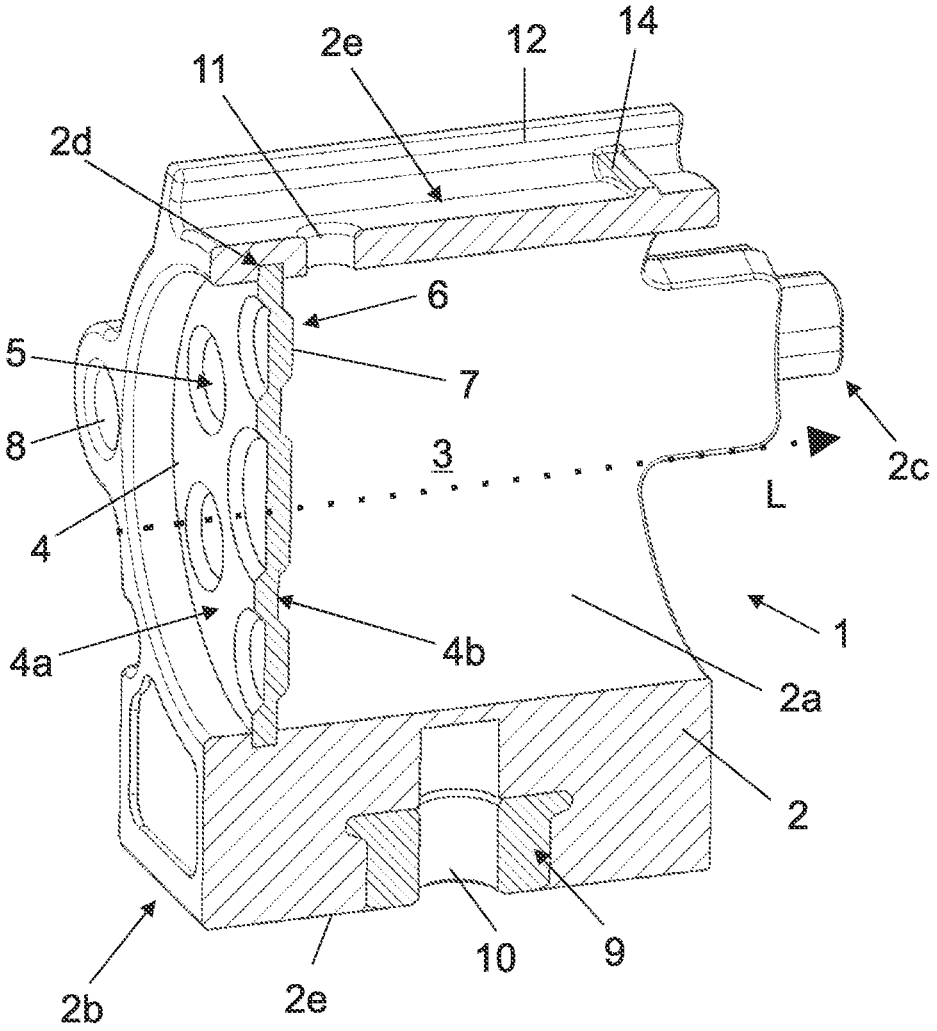
FIG. 1 shows a first embodiment of a retainer housing according to the present disclosure for a door check.

FIG. 1 shows a first embodiment of a retainer housing 1 according to the present disclosure for a door check. The retainer housing 1 comprises a housing part 2, which, in this case, can be seen in a sectioned view parallel to the longitudinal axis L of the housing part 2. As can be clearly seen, the hollow cylindrical housing part 2 has a cavity 3 which is provided for receiving a spring system and a brake body of a door check. The cavity 3 is delimited by an inner face 2*a* of the housing part 2. The housing part 2 has a first end 2*b* and a second end 2*c*, wherein a closing piece 4 is arranged at the first end 2*b* of the housing part 2, which closes the first end 2*b* of the housing part 2 or the cavity 3 on one side. An upper face 4*a* of the closing piece 4 has a plurality of circular depressions 5 and the lower face 4*b* of the closing piece 4 has accordingly corresponding circular elevations 6.

In the embodiment of a retainer housing shown in FIG. 1, some of the elevations 6 are arranged concentrically about a center of the closing piece 4, wherein elevations 6 adjacent to one another have the same distance from one another. Furthermore, an elevation 6 is arranged in the center of the closing piece 4. The elevations 6 each have a flat stop surface 7, with which a spring system arranged in the cavity can be brought into contact and thus forms an abutment for the spring system. The stop surface 7 has a circular border and faces the second open end 2*c* of the housing part 2.

Figure 3:
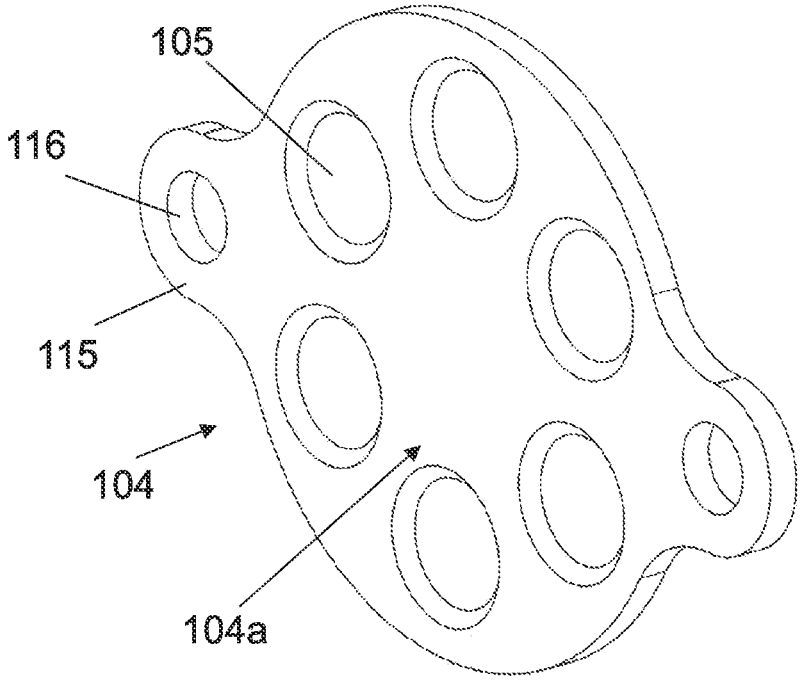
FIG. 3 shows the closing piece of the retainer housing from FIG. 2 in a perspective view.

In one side region, the housing part 2 has a bore 8 which runs parallel to the longitudinal axis L and said bore is designed for receiving a rivet pin shown in FIG. 3. The rivet pin serves on the one hand to connect the first housing part 2 and a second housing part and at the same time to fix the closing piece 4, in particular with respect to a rotary movement.

On a lower face 2*d* of the housing part 2 there is provided a recess 9 which is T-shaped in cross section and in which a fastening part 10 made of metal is arranged in a positive manner. The fastening part 10 is expediently used for fastening the housing part 2 to one of the body part and the flap part of a vehicle, the fastening part 10 having an internal thread so that the housing part 2 can be fastened easily and safely via a screw connection.

On an upper face 2*e* of the housing part 2, a hole 11 is provided, which serves to allow water that has accumulated in the cavity 3 to flow off. This advantageously prevents impairment of the functionality, in particular of the spring system and of the brake body preloaded by the spring system.

Furthermore, two ridges 12 running parallel to the longitudinal axis L of the housing part 2 are provided on the upper face 2*e*, only one of the two ridges 12 being visible in the sectional view shown in this case. A resilient piece of material 13 shown in FIG. 2 can be pressed into the second end 2*c* of the housing part 2 between the ridges 12, the piece of material 13 serving as a stop buffer to dampen noises when closing the door.

In order to prevent the piece of material 13 from being displaced in the direction parallel to the longitudinal axis L of the housing part 2, a web 14 running approximately perpendicular to the ridges 12 is provided on the upper face 2*e*. The piece of material 13 has a corresponding recess 13*a* on the lower face thereof, so that the web 14 is fitted into the recess 13*a* when the piece of material 13 is arranged on the upper face 2*e* of the housing part 2.

Figure 2:
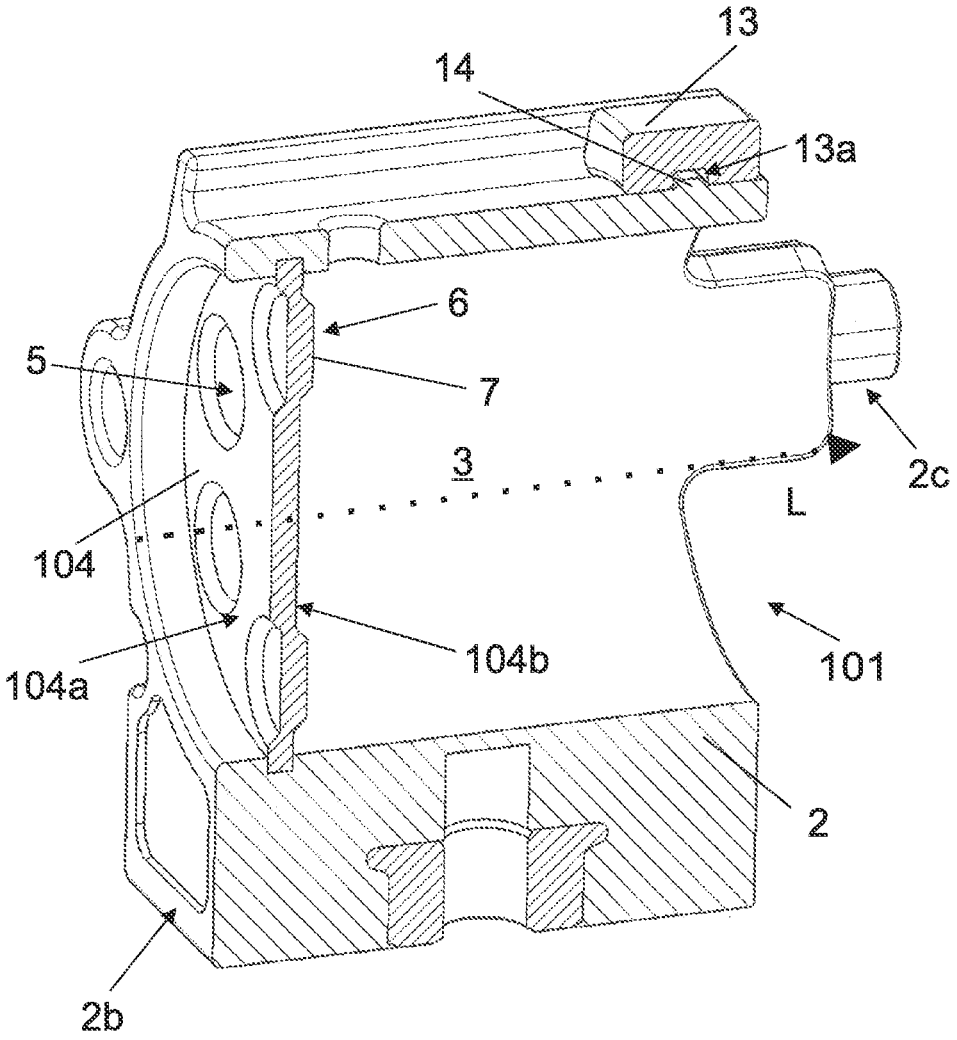
FIG. 2 shows a second embodiment of a retainer housing according to the present disclosure for a door check.

FIG. 2 shows a second embodiment of a retainer housing 101 according to the present disclosure for a door check. Components that are structurally the same as those of the first embodiment in FIG. 1 are provided with the same reference signs, whereas structurally changed components have been given a reference sign incremented by 100.

Compared to the first embodiment from FIG. 1, the closing piece 104 used in the second embodiment does not have a central elevation 6 in the center of the closing piece 4, but rather elevations 6 arranged equidistant from one another and circularly about the center of the closing piece.

FIG. 3 shows the closing piece 104 of the retainer housing from FIG. 2 in a perspective view. As can be clearly seen, the closing piece 104 is designed as an embossing plate made of metal, wherein a nose-shaped projection 115 is provided on two opposing sides, wherein a bore 116 respectively is provided in the projection 115, which is used to guide the rivet pin shown in FIG. 4 or to fix the closing piece 104 in the housing part 2.

Figure 4:
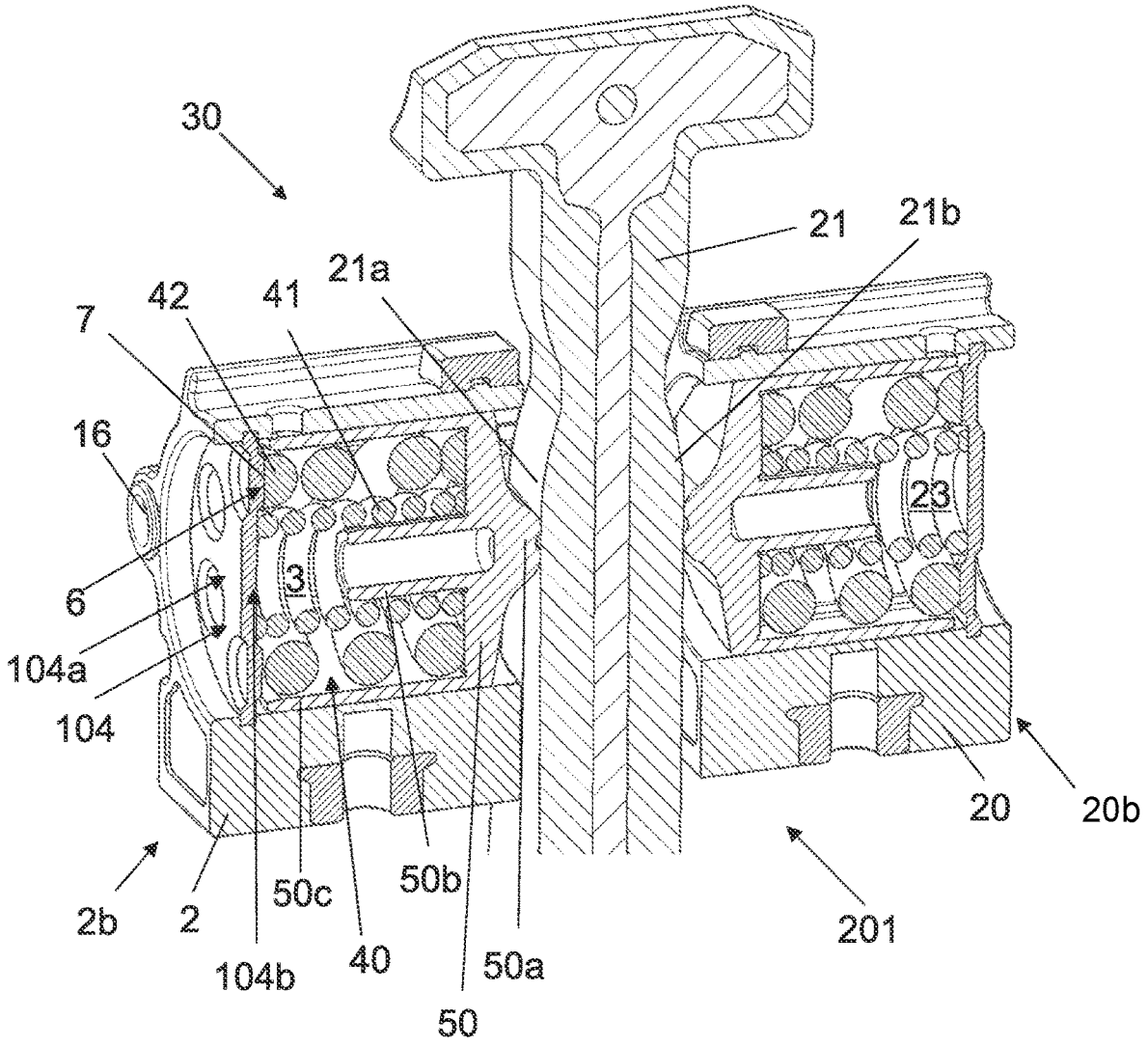
FIG. 4 shows a preferred embodiment of a door check according to the present disclosure.

FIG. 4 shows a preferred embodiment of a door check 30 according to the present disclosure. The door check 30 comprises the first housing part 2 shown in FIG. 2, a second housing part 20 being arranged opposite the first housing part 2, which is otherwise constructed in the same way as the first housing part 2. The two housing parts 2, 20 are connected to one another via two rivet pins 16, only one of the rivet pins 16 being visible in the cut-away view shown in this case. A coherent retainer housing 201 is formed thereby.

In the cavities 3, 23 of the first housing part 2 and the second housing part 20, a spring system 40 and a brake body 50 are arranged, which are designed as half-open hollow cylinders, the closing end portion 50*a* thereof facing one another and protruding from the cavity 3, 23. A door retaining rod 21 passes through the retainer housing 201 formed by the first housing part 2 and the second housing part 20, the brake bodies 50 arranged in the cavities 3, 23 touching two opposing guide surfaces 21*a*, 21*b* and thus providing the desired braking effect.

The braking member 50 has an inner hollow cylinder 50*b* which adjoins the end portion 50*a* and projects into the cavity 3, 23 and which is surrounded by an outer hollow cylinder 50*c*. The outer hollow cylinder 50*c* runs radially around a first end of the spring system 40 preloading the first brake body 50 against the guide surface of the door retaining rod, wherein the first end is facing the end portion 50*a*.

The spring system 40 comprises a first helical spring 41 which rests in a positive manner on an outer face of the inner hollow cylinder 50*b* or runs around it. The first helical spring 41 passes completely through the braking member 50 and the second end thereof rests against the closing piece 104, which closes the cavity 3, 23 at a first end 2*b*, 20*b* of the respective housing part 2, 20 facing away from the end portion 50*a*. It is thereby achieved that the first helical spring 41 preloads the axially displaceable braking member 50 against the guide surface 21 *a*, 21 *b* of the door retaining rod 21.

The spring system 40 further comprises a second helical spring 42, which has a larger outer diameter than the first helical spring 41 and which runs radially around the first helical spring 41. The second helical spring 42 rests with a first end on an inner face of the first end portions 50*a* of the brake body 50 and with the second end thereof on the flat stop surfaces 7 of the concentrically arranged elevations 6 arranged on the lower face 104*b* of the closing piece 104. This ensures that the second helical spring 42 also preloads the axially displaceable braking member 50 against the guide surface 21*a*, 21*b* of the door retaining rod 21, the preload being able to be set by setting or selecting the height of the elevations 6.

A door check according to the present disclosure was explained above on the basis of an embodiment in which the braking members and the spring system are arranged or formed mirror-symmetrically to one another. It is understood that the two braking members, which are arranged mirror-symmetrically to the door retaining rod, can each also be preloaded against the first and second guide surfaces by different spring systems. In this case it can also be provided that the closing pieces used are adjusted accordingly.

The door check according to the present disclosure explained above with reference to an embodiment is preferably intended for installation in automobiles. A first end of the door retaining rod is attached to a stationary body part so that it can pivot about an axis, and the second end of the door retaining rod is fastened to the pivoting door. The retainer housing, in which the braking members and the spring systems which preload them against the opposing guide surfaces of the door retaining rod are accommodated, is advantageously accommodated in an inner region of the door. As an alternative to this, however, a receptacle can also be provided in the body part.

What is claimed is:

1. A retainer housing for a door check, comprising:

a first housing part with a cavity for receiving a brake body and a spring system of a door check, the first housing part having a first end and a second end; and a closing piece which is arranged on one of the first end and second end of the housing part, wherein the closing piece has an upper face and a lower face, wherein a plurality of elevations are arranged on the lower face of the closing piece, concentrically around a center of the lower face, wherein the elevations have a stop surface for a spring system of a door check.

2. The retainer housing according to claim 1, wherein adjacent elevations are arranged equidistant from one another.

3. The retainer housing according to claim 1, wherein the lower face or the elevations face the other of the first end and the second end of the housing part.

4. The retainer housing according to claim 1, wherein the spring system has a first end which is in contact with the stop surface of the elevations.

5. The retainer housing according to claim 4, wherein a second end of the spring system is in contact with a stop surface of the brake body.

6. The retainer housing according to claim 1, wherein the stop surface of the elevations has a flat design.

7. The retainer housing according to claim 1, wherein the stop surface is convex.

8. The retainer housing according to claim 1, wherein the stop surface has a circular border.

9. The retainer housing according to claim 1, wherein the elevations are designed as embossed dimples.

10. The retainer housing according to claim 1, wherein the stop surface is designed in an arc shape.

11. The retainer housing according to claim 1, wherein the closing piece is fixed to an inner face of the housing part surrounding the cavity.

12. The retainer housing according to claim 11, wherein the inner face of the housing part has a groove for receiving an edge region of the closing piece.

13. The retainer housing according to claim 1, wherein the closing piece is designed as a plate made of metal.

14. The retainer housing according to claim 1, wherein at least three elevations are arranged on the lower face of the closing piece, the center points of which span a triangle.

15. A door check, comprising the retainer housing according to claim 1;

a door retaining rod passing through the retainer housing, the door retaining rod having a first guide surface;

a first brake body; and a first spring system, wherein the first spring system preloads the brake body in the direction towards the first guide surface.

16. A method for producing a retainer housing for a door check, comprising:

embossing a metal sheet provided as a closing piece, which has one or more bores in an edge region, in an embossing tool, wherein one or more elevations are produced on a lower face;

inserting the pre-embossed metal sheet into an injection molding tool;

producing a housing part made of plastic with simultaneous encapsulation of the edge region of the pre-embossed metal sheet with the plastic; and pushing back one or more of the previously produced elevations on the lower face of the metal sheet.

* * * * *